US006544150B1

(12) United States Patent
Samodoumov

(10) Patent No.: US 6,544,150 B1
(45) Date of Patent: Apr. 8, 2003

(54) SYSTEM, METHOD AND APPARATUS FOR PERFORMING WEIGHT TRAINING EXERCISES

(76) Inventor: Anatoly Ivanovich Samodoumov, Moscow Region, City Serpukhov (RU)

( * ) Notice: Subject to any disclaimer, the term of this patent is extended or adjusted under 35 U.S.C. 154(b) by 0 days.

(21) Appl. No.: 09/477,925

(22) Filed: Jan. 5, 2000

(51) Int. Cl.[7] ..... A63B 21/06

(52) U.S. Cl. ..... 482/93; 482/104; 482/105; 482/106; 482/107; 482/108

(58) Field of Search ..... 482/93, 104–108; 2/132; 411/531, 500; 81/9.3; 24/455, 155; 292/305; 188/234

(56) References Cited

U.S. PATENT DOCUMENTS

| | | | | | |
|---|---|---|---|---|---|
| 882,181 | A | | 3/1908 | Thomas | |
| 3,322,425 | A | * | 5/1967 | Moore | 272/84 |
| 3,370,850 | A | * | 2/1968 | Moore | |
| 3,679,107 | A | * | 7/1972 | Perrine | 224/5 P |
| 3,751,031 | A | | 8/1973 | Yamancort | |
| 4,482,151 | A | * | 11/1984 | Zwilling | 482/106 |
| 4,484,740 | A | * | 11/1984 | Green | 482/105 |
| 4,589,658 | A | | 5/1986 | Gibson | |
| 4,984,786 | A | | 1/1991 | Lemke et al. | |
| 5,062,631 | A | * | 11/1991 | Dau et al. | 482/107 |
| 5,118,100 | A | * | 6/1992 | Sungaila | 482/105 |
| 5,433,288 | A | * | 7/1995 | James | 182/3 |
| 5,472,398 | A | * | 12/1995 | Silverman | 482/105 |
| 5,588,940 | A | | 12/1996 | Price et al. | |
| 5,853,355 | A | * | 12/1998 | Standish | 482/106 |
| 5,957,818 | A | * | 9/1999 | Betournay | 482/105 |

* cited by examiner

*Primary Examiner*—Jerome W. Donnelly
*Assistant Examiner*—Lori Baker Amerson

(57) ABSTRACT

A weight lifting system has a plurality of weighted disks each disk having an aperture in the center thereof. A barbell with ends each formed to receive the aperture of at least one of the weighted disks thereon and a hoisting belt connected to the barbell is provided. The weight lifting system further includes a connecting star having an aperture sized to fit around the barbell and wherein the hoisting belt is connected to the barbell using the connecting star and a connecting bar. The weight lifting system further provides that the connecting star has a plurality of various sized loops wherein the belt has a connecting bar sized to fit within those loops. A belt for lifting a barbell is provided wherein the belt has a flat portion and a connecting structure attached to each of those ends. The present invention also provides a method for lifting a barbell using a belt including the steps of connecting the belt to the barbell and the lifting the belt. The belt is placed over the lower back and the lifting step is performed using a limited range of motion.

27 Claims, 10 Drawing Sheets

SYSTEM, METHOD AND APPARATUS FOR PERFORMING WEIGHT TRAINING EXERCISES

FIELD OF THE INVENTION

This invention relates generally to the field of gymnastic exercise and equipment therefore, and more particularly to a system, apparatus and method for performing gymnastic exercises comprising the lifting of heavy weights through a limited range of motion safely and effectively.

CROSS REFERENCES TO RELATED APPLICATIONS

Not Applicable

STATEMENT REGARDING FEDERALLY SPONSORED RESEARCH

Not Applicable

REFERENCE TO MICROFICHE APPENDIX

Not Applicable

BACKGROUND OF THE INVENTION

Exercise and health go hand in hand. Man has known the health benefits of exercise and has learned to exploit those benefits over many, many years. Indeed, exercise has become synonymous with a healthy lifestyle. Some health benefits are well documented, others are not as well understood.

Advances in physiological studies and technology have led to advanced and evolving exercising techniques. Most of the advances are subtle, and therefore accepted, and those that are not, are often thought to be radical, harmful, or useless. Such evolutionary advances in exercising techniques manifest themselves in many ways: world class athletes are better than ever, heart attack victims are recovering and doing so more quickly and able to resume normal lifestyles, and people who exercise claim to just plain feel better or have more energy.

For many many years, men and women have used weight training for building strength, increasing endurance, body building, and athletic training. Weight training has also been used for flexibility conditioning. Variations in weights and number of repetitions of particular exercises can tailor an individual's weight training to achieve specific goals. The duration of workouts and the frequency of those workouts may also be varied to achieve desired goals. Variations in the range of motion can help strike a balance between strength and flexibility, again tailored to the desired results of the individuals. Examples of medical applications for weight training are also abundant.

The typical exercise regimen requires that an individual dedicate a significant amount of time and energy to achieve results, often building up to a certain frequency of workouts. The buildup to a maximum lifting capability is also often slow and tedious. The slowness of achieving results, along with the number of workouts per week required to achieve those results, can and often does hurt an individual's motivation to continue. If and when results are achieved, simply continuing to maintain those gains requires virtually the same investment of time and energy. The inventor of the present application is not aware of a field of exercise in which an individual is able to reduce the amount of time and frequency of workouts as you progress to achieve and maintain optimum body conditioning.

Moreover, typical weight training regimens, regardless of whether desired results include bulk, strength, flexibility, or a combination thereof, focus on working muscles through their fill range of motion. By way of example, as known by those skilled in the art, one form of bench press exercises requires an individual to lift a bar by extending the arms straight in the air while laying on his/her back, with the bar handle starting from just above the chest, and then returning the bar back to its original position. Another form of bench press exercise has the starting position of the bar at a height consistent with fully extended arms, and then lowering the bar to just above chest level and then raising it back to its original level. Either method requires that the muscles in the arms be worked through a full range of motion. As will be appreciated by those skilled in the art, other exercises, including but not limited to, the dead lift, clean and jerk, squats, and curls similarly require a full range of motion for maximum benefit.

From time to time advances in exercise techniques are revolutionary and not evolutionary. The present invention is such a revolutionary change. The present invention teaches away from the standard and accepted techniques for weight training to achieve not only the desired results, but truly fascinating and unexpected results. Physically, the results are manifested by individuals being able to lift extraordinary amount of weights using the techniques and apparatus of the present invention. Moreover, individuals are able to rapidly progress to the point of being able to lift their personal maximum amounts of weight sooner than in traditional weight lifting methods. Mentally and emotionally, the results of weight training according to the present invention are also unexpected and unfortunately, scientifically undocumentable by the inventor at this time. Nonetheless, the mental and emotional results are the subject of individual anecdotal testimony about the personal benefits achieved by individuals in that regard, and in fact, it is the belief of the inventor that the techniques and apparatus of the present invention may ultimately find an accepted place among alternative medicine practices.

Accordingly, it is an object of the present invention to provide a system, method and apparatus for improved weight training techniques. It is an additional object of the present invention to provide a system for weight training that allows continued progression quickly while reducing the frequency of workouts over time. It is yet another object of the invention to provide a system which permits the lifting of extremely heavy weights, much more than traditional weight lifting exercises, through a relatively limited range of motion. Finally, another object of the invention is to provide an exercise system where over time a person's energy level increases and which may possibly be used for alternative medical treatment.

Some advantages of the system will be readily apparent to an individual user, others may be more subtle and less measurable. For example, an individual user will be able to lift more weight than through traditional weight lifting exercises and be able to achieve intermediate maximum plateaus more quickly. Furthermore, the user will be able to achieve results without the traditional muscle or joint soreness associated with traditional weight lifting techniques. Anecdotal evidence suggests that the limited number of users who have worked through the system and method of the present invention have achieved greater energy levels and increased their ability to focus in other areas of their life, while yet others have enjoyed medicinal benefits of the weight training exercises. Finally, an additional advantage is that the method is safe and reliable. Because of the extreme amounts of weight involved, should a user be unable to practice the acceptable technique required to lift the weights or add more weight than can be lifted, the weights simply will not budge, thereby reducing the risk of injury.

Additional objects, advantages and novel features of the invention will be set forth in the description which follows, and in part will become apparent to those skilled the art or upon examination of the following detailed description or may be learned by practice of the invention. The detailed description shows the preferred embodiment of the invention by way of illustration of the best mode contemplated for carrying out the invention. As will be realized, the invention is capable of other and different embodiments, and its several details are capable of modifications in various obvious respects, all without departing from the scope and spirit of the present invention. Accordingly, the drawings and descriptions are to be regarded as illustrative in nature, and not as restrictive.

SUMMARY OF THE INVENTION

The present invention is directed to a weight lifting system having a plurality of weighted disks, with each disk having an aperture in its center. A barbell receives the aperture of at least one of the weighted disks on each end and a hoisting belt connected to the barbell is provided. The weight lifting system further includes a connecting star having an aperture sized to fit around the barbell and wherein the hoisting belt is connected to the barbell using the connecting star and a connecting bar. The weight lifting system further provides that the connecting star has a plurality of various sized loops wherein the belt has a connecting bar sized to fit within those loops. A belt for lifting a barbell is provided wherein the belt has a flat portion and a connecting structure attached to each of those ends. The present invention also provides a method for lifting a barbell using a belt including the steps of connecting the belt to the barbell and the lifting the belt. The belt is placed over the lower back and the lifting step is performed using a limited range of motion.

BRIEF DESCRIPTION OF THE DRAWINGS

The preferred embodiments of the present invention will be described in greater detail with reference to the accompanying drawings, wherein like members designate like reference numerals and wherein.

DETAILED DESCRIPTION OF THE PREFERRED EMBODIMENT

Figure 1:
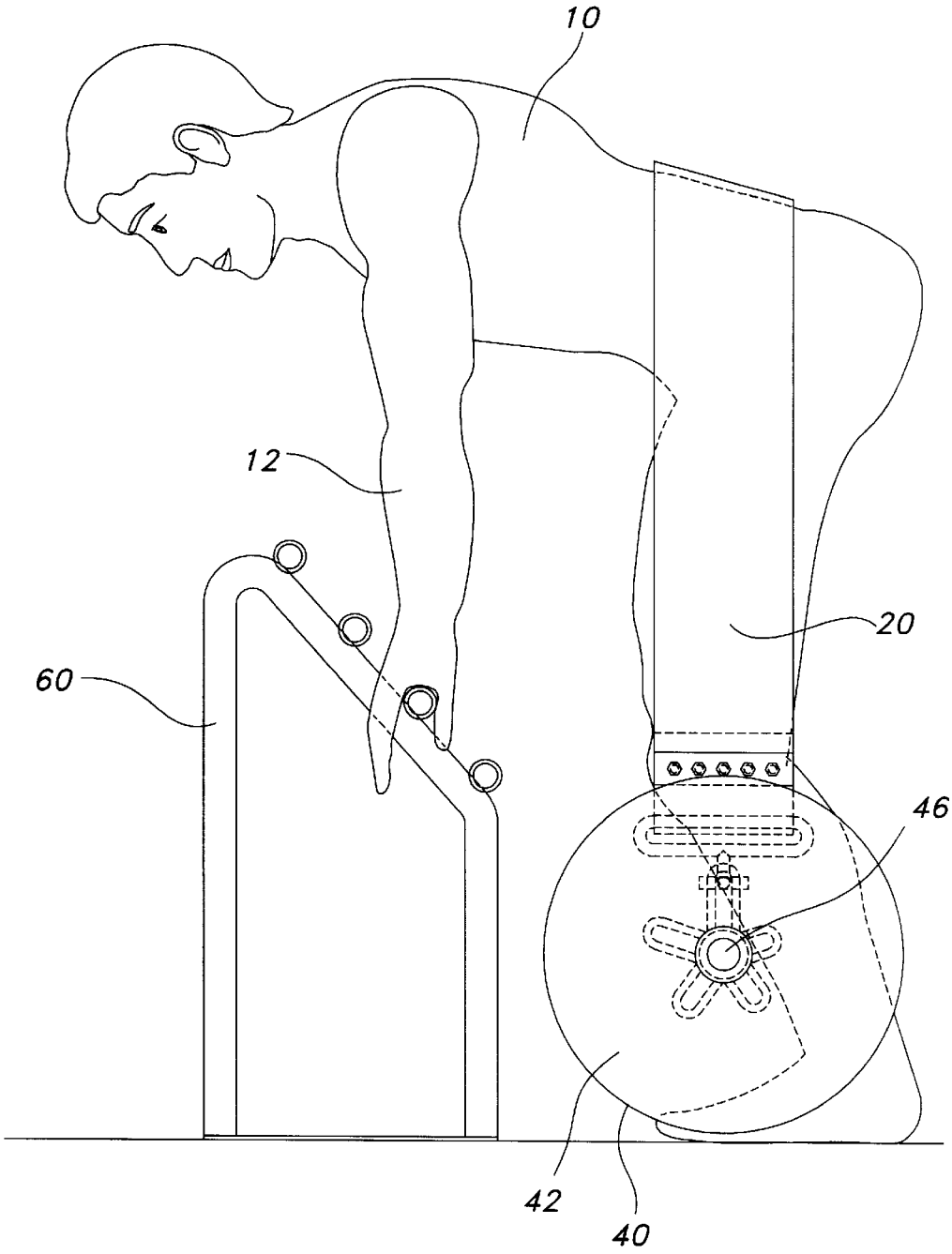
FIG. 1 is a side view showing the belt over lower back lifting operation of the present invention.

With reference to FIG. 1, there is shown a silhouetted FIG. 10 in the initial position for what I have called the belt over lower back lifting operation. The FIG. 10 represents a user of the system and accordingly, the terms "figure" and "user" may be used interchangeably herein. Likewise, the figures 110, 210, 310, 410 shown in FIGS. 11, 12, 13, and 14, respectively also represent users and the terms "figure" and "user" will be similarly treated.

Figure 2:
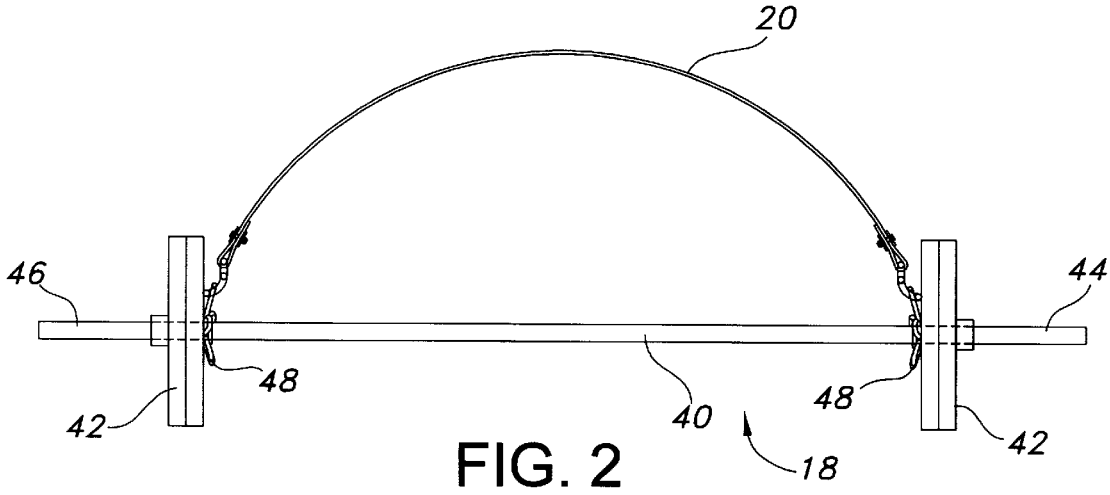
FIG. 2 is a top view of a lifting apparatus (at rest) constructed according to the present invention showing a barbell, weighted disks, a hoisting belt, and a connecting star.

A hoisting belt 20, is attached to a barbell 40 with free weights 42 attached thereon. The hoisting belt 20 will be further described below. As will be appreciated by those skilled in the art, free weights 42 are preferably weighted disks with an aperture in the center thereof for receiving one end 44, 46 of the barbell 40 thereon. Moreover, the amount of free weights 42 on the bar belt should be equally distributed on either end 44, 46 of the barbell 40 as illustrated in FIG. 2. Because of the extreme weight to be lifted according to the methods of the present invention, it is preferred that the barbell 40 be constructed of a strong material, including but not limited to steel or other metals or metal alloys. However, it is contemplated that any type of weighted bar may be used in lieu of the traditional barbell, or a combination of a weighted bar and free weights 42, but preferably the total weight of the bar and the type of weight added to the bar (if any) is conveniently variable.

Figure 4:
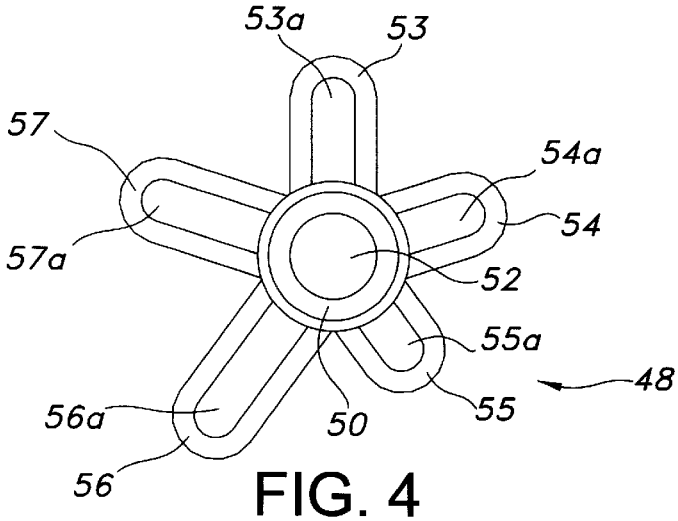
FIG. 4 is a side view of the connecting star which connects the hoisting belt of FIG. 3 to the barbell shown in FIG. 2.

The weight apparatus 18 is shown in FIG. 2. The hoisting belt 20 is attached to the barbell 40 using two connecting stars 48. Referring to FIG. 4, the connecting star 48 is preferably constructed of a strong material, either cast iron, steel or other type of strong composite material, such material being capable of supporting the expected maximum amount of weight on the barbell 40 to be lifted, which in demonstrations has far exceeded two thousand pounds. A preferred embodiment of the connecting star 48 is configured as a star, with a center area 50 defining an aperture 52 for receiving one end 44, 46 of the barbell 40 therethrough. Each of the points of the star 53, 54, 55, 56, 57 is defined by a loop of steel connected to the center area 50, forming an opening 53*a*, 54*a*, 55*a*, 56*a*, 57*a* configured to receive a connecting end 24 of the hoisting belt 20 therein. It is preferable that the entire connecting star 48 be one piece construction, so that the points of the star 53, 54, 55, 56, 57 are integrally formed with the center area 50. It is also preferable that the openings 53*a*, 54*a*, 55*a*, 56*a*, 57*a* be of different sizes with respect to the others. As will be appreciated by those skilled in the art, using two connecting stars 48 to attach the hoisting belt 20 to the barbell 44 will result in having up to fifteen different size settings of the lifting apparatus 18 to accommodate a variety of user 10 sizes. Other configurations of the connecting star 48 are possible in accordance with the spirit of the present invention, with the number and size of the openings varied to accommodate a trade-off between simplicity and versatility.

Moreover, the hoisting belt may be attached directly to the barbell 40 without use of the connecting star 48. As will be further appreciated by those skilled in the art, the hoisting belt 20 may be attached to the barbell 40 in a variety of different ways, provided the strength and stability needed are provided. By way of example only, the hoisting belt 20 may attach via mating screws, buckles, ties, bands, snap-on connectors (including but not limited to male-female cooperating connectors), clips or any other type of connecting structure.

Figure 3:
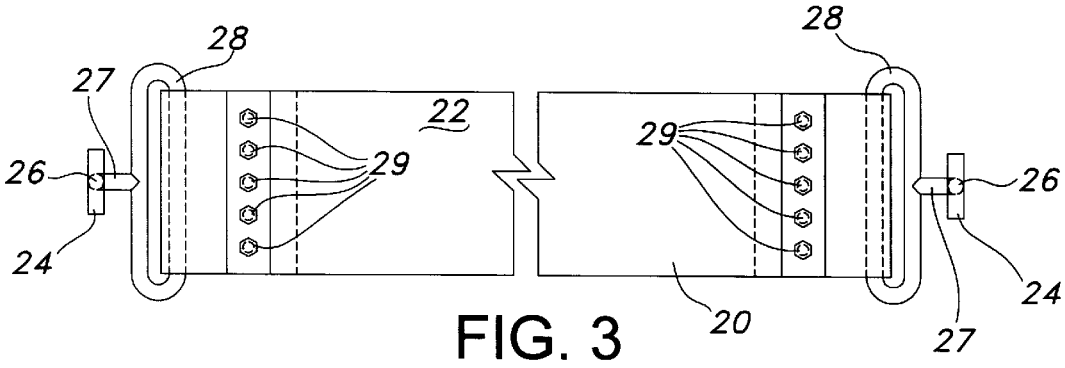
FIG. 3 is a planar view of the hoisting belt shown in FIG. 2.

With reference to FIG. 3, the hoisting belt 20 preferably includes a large, flat belt 22 and two connecting bars 24 on either end thereof The hoisting belt 20 is preferably about eight (8) inches in width and its length should be sufficient to reach from the barbell 44, around the lower back of the user 10, and back down to the barbell 44, with the connecting star 48 providing any variations in length needed to for various users. Variations in size required beyond that obtainable by the connecting stars 48 should preferably accomplished by using a different length belt. I recommend color coding the belts, and documenting the connecting openings 53*a*, 54*a*, 55*a*, 56*a*, 57*a*, so the users select the right size belt and configure the hoisting belt 20 to the correct length for their particular height. The hoisting belt 20 is preferably made of a non-elastic, high tensile strength material, and preferably is material similar or identical to that used for conveyor belts, but may be made of any other suitably strong, non-elastic material. The connecting bars 24 are preferably constructed using cast iron, but may be constructed using any suitably strong material. The connecting bars 24 are preferably of a modified "H" configuration, having a smaller insert bar 26 and a larger retaining bar 28 attached to each other by a horizontal member 27. I prefer to connect the connecting bars 24 to the belt 22 by creating two holes (not shown) in the belt about four (4) to six (6) inches from either end, sized so that the insert bar 26 extends through the hole, but the retaining bar 28 cannot extend through the hole. The belt 22 is then folded back over itself and secured using rivets 29 or another suitable type of fastener.

Figure 5:
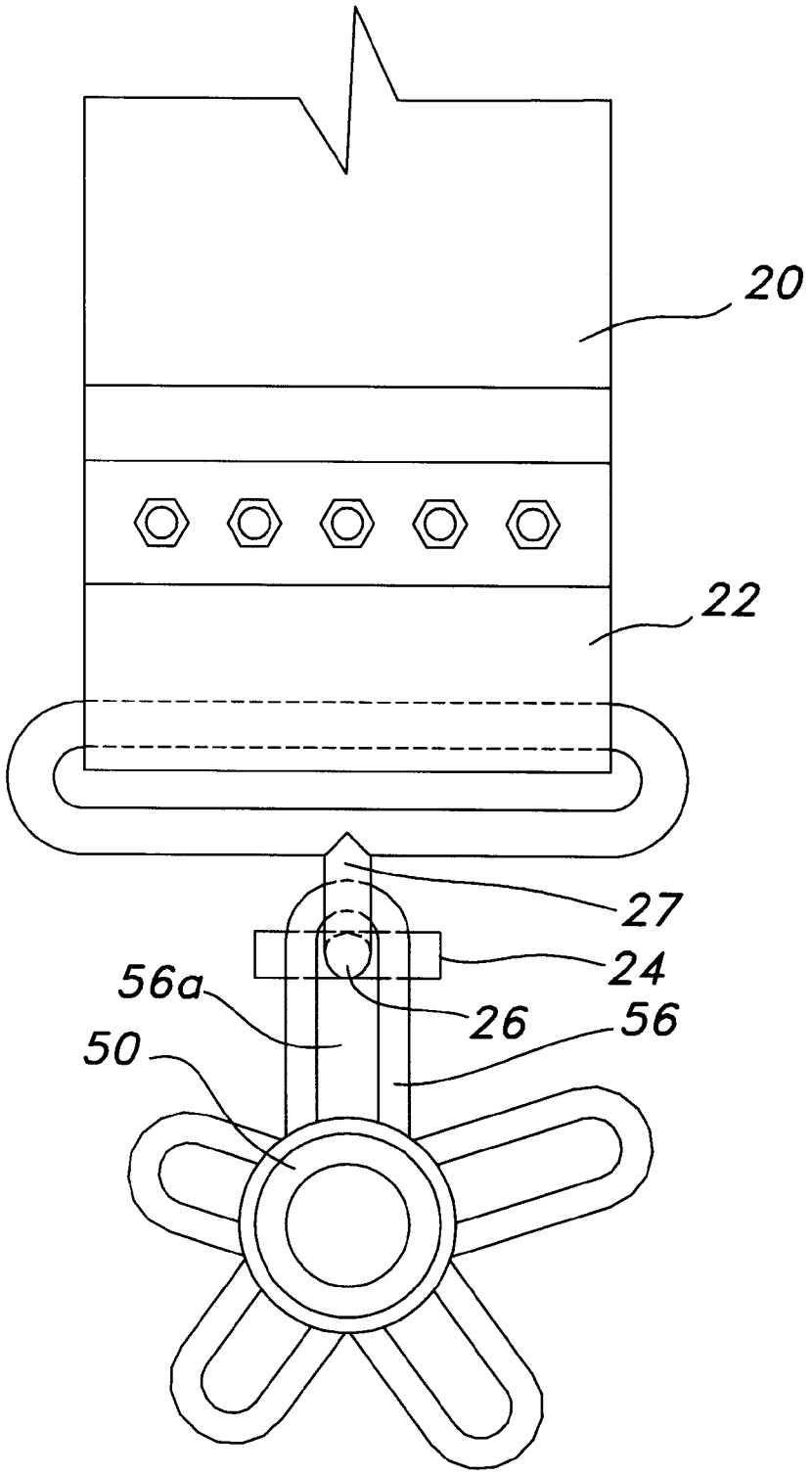
FIG. 5 is a detailed drawing showing the connection between the hoisting belt and the connecting star.

With reference to FIG. 5, there is shown a preferred connection between the hoisting belt 20 and the connecting star 50. The insert bar 26 of the connecting bar 24 is inserted into one of the openings 53*a*, 54*a*, 55*a*, 56*a*, 57*a* (shown as 53*a* in FIG. 5). As will be appreciated by those skilled in the art, such a connection is made by turning the connecting bar 24 approximately ninety degrees (from that shown in FIG. 5) to thread the insert bar 26 through the opening 53*a*, thereby aligning the long portion of the loop 53*a* with the insert bar 26. Once the insert bar 26 is threaded through the opening 53*a*, the connecting bar is rotated back to the position shown in FIG. 5, thereby forming a secure connection which permits the hoisting belt to lift the connecting star 50 and thus the barbell 40.

Figure 6:
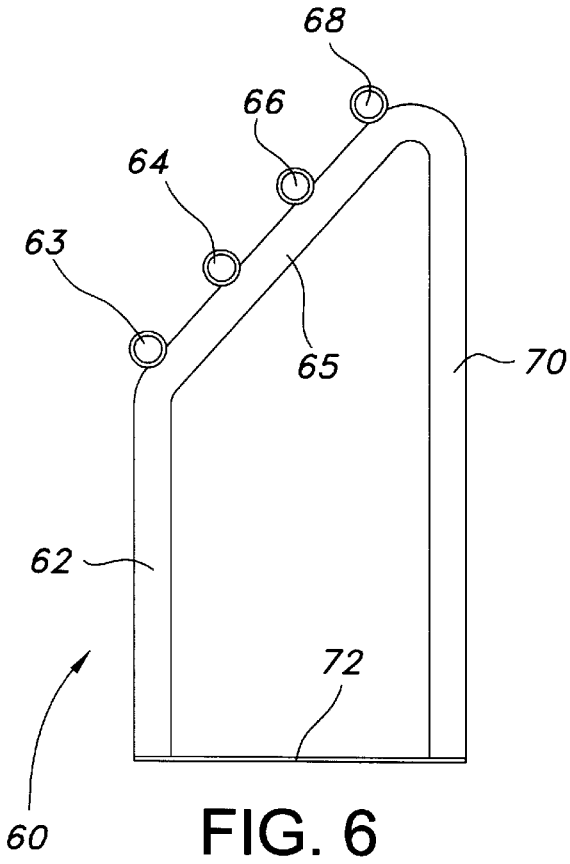
FIG. 6 is a side view of one embodiment of the upper body support structure shown in FIG. 1.
Figure 7:
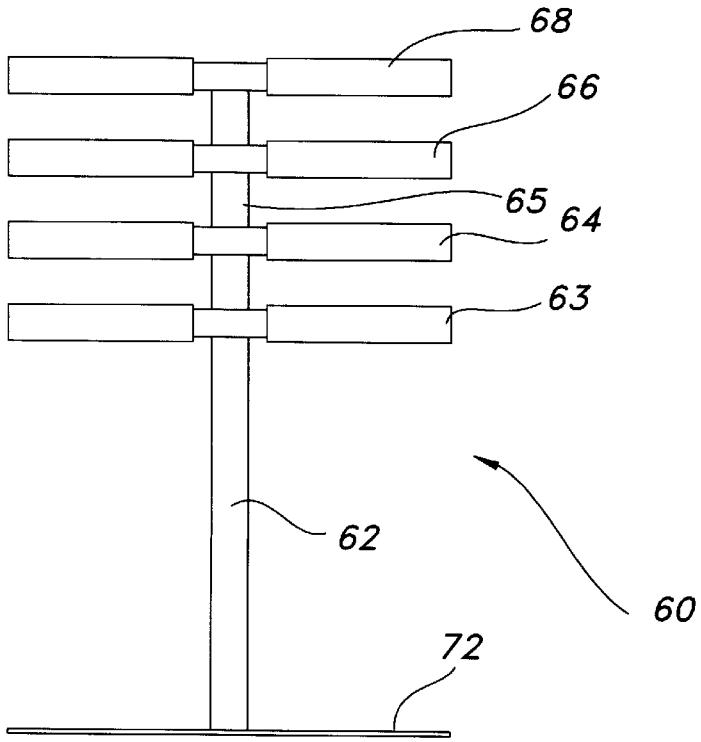
FIG. 7 is a front view of the embodiment of the upper body support structure shown in FIG. 6.

Referring again to FIG. 1, the arms 12 of the silhouetted FIG. 10 are shown being supported by an upper body support structure 60. The function of the upper body support structure 60 is to support the upper body in a forward leaning position, thereby allowing the hoisting belt 20 to be placed over the lower back and upper pelvic area of the user 10. With reference to FIGS. 6 and 7, a preferred embodiment of the upper body support structure 60 is shown. The upper body support structure 60 preferably includes multiple hand grips 63, 64, 66, 68, each set at a different height to accommodate different sizes of individuals. The hand grips 63, 64, 66, 68 are connected to each other by a diagonal member 65 and supported in the front by vertical member 62 and in the rear by vertical member 70. A base 72 extending perpendicular to the vertical member 70 and optionally (but not shown as such) also supporting vertical member 62 adds stability to the upper body support structure 60. An additional base bar 61 may be used to support vertical member 62 if the base 72 is not used for that purpose.

Figure 8:
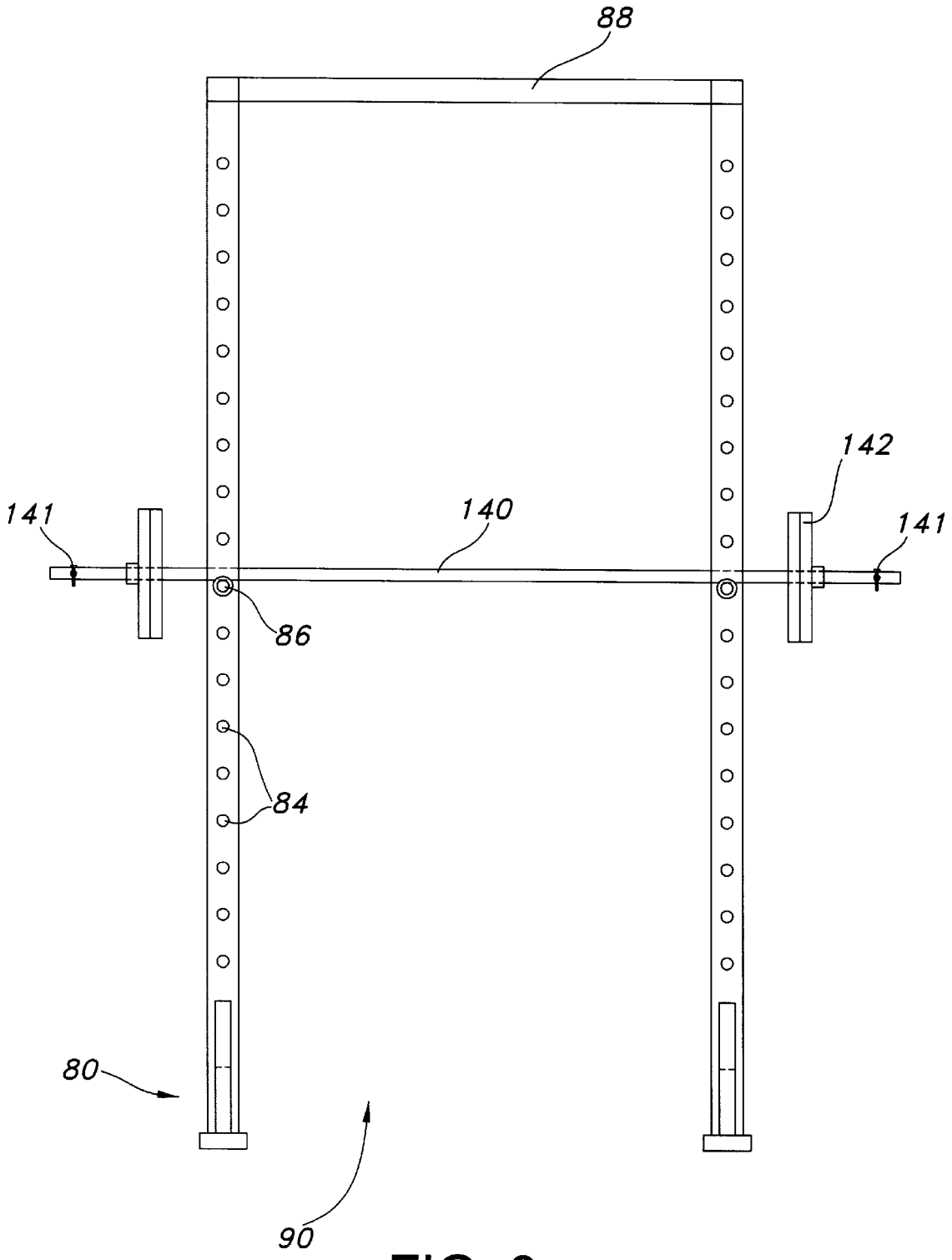
FIG. 8 is a front view of a barbell support structure.
Figure 9:
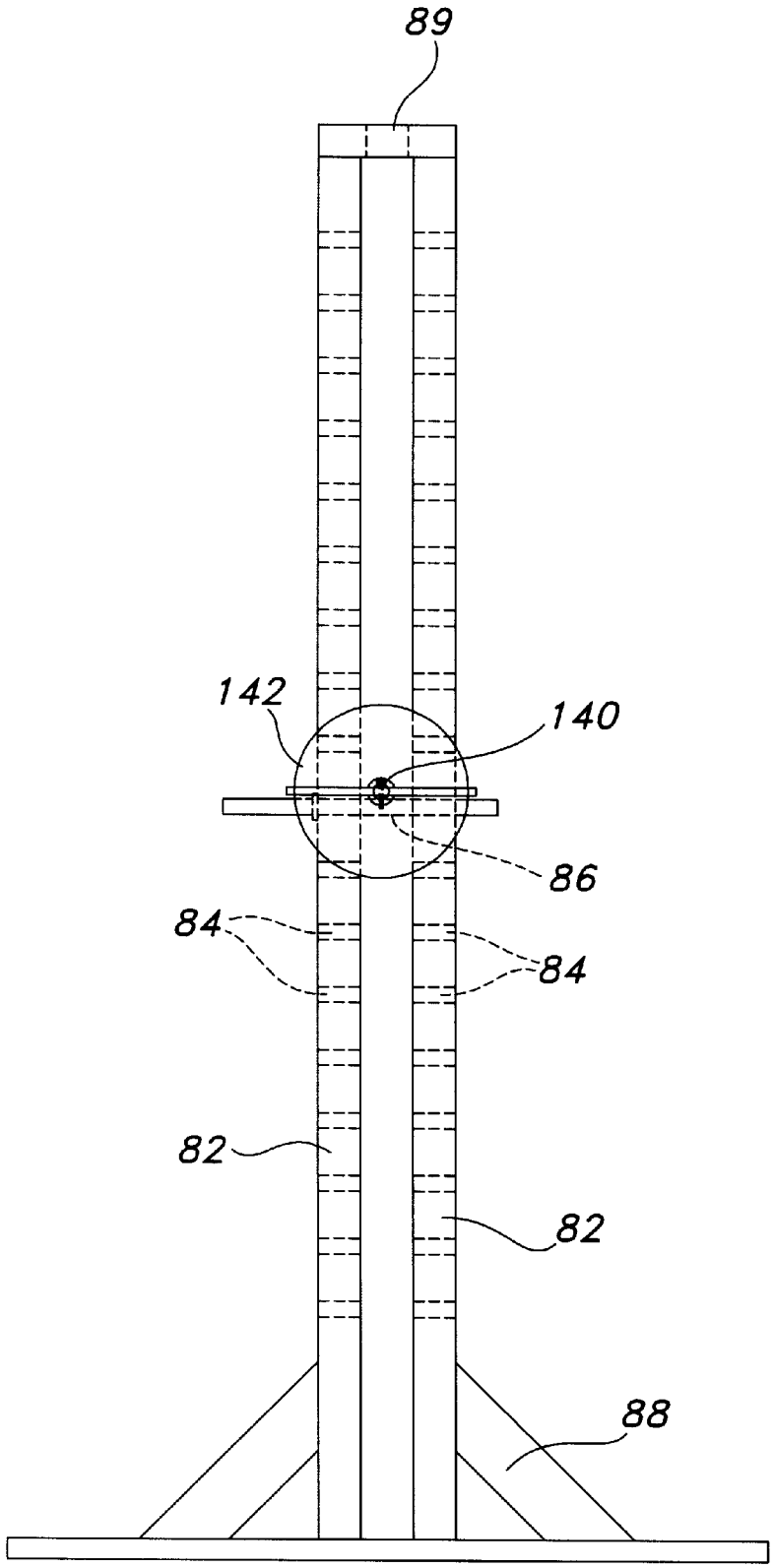
FIG. 9 is a side view of the barbell support structure shown in FIG. 8.

In addition to the various apparatus described in FIGS. 2–7, other exercises performed in accordance with the present invention use a barbell support apparatus 80 as shown in FIGS. 8 and 9. The barbell support apparatus 80 is designed to adjustably support a barbell 141 at a desired starting location and provide for enough free movement of the barbell 141, while ensuring that the heavy weights are both stable and secure. The barbell support apparatus 80 is preferably a steel structure forming two upside down, square "U's", both as viewed from the front and the side. With respect to the front view shown in FIG. 8, the barbell support apparatus 80 has two vertical members 82 connected to each other by a horizontal member 88. Each vertical member has equally spaced holes 84 sized to receive a retaining pin 86 therethrough. As will be appreciated those skilled in the art, the retaining pins 86 should be inserted in holes 84 on either vertical member 82 so that the barbell 140 resting on the retaining pin 86 rests parallel to the floor. The vertical members 82 are supported by a base 88. With respect to the side view shown in FIG. 9, each of the vertical members 82 are connected to an additional vertical member 82 by a second horizontal member 89. Again, corresponding holes are in the additional vertical member 82 for receiving the retaining pins 86. As shown, the barbell support apparatus 80 permits the barbell 140 to move from a resting position on the retaining pins 86 upwards to the horizontal members 88, 89, and between the vertical members 82. Weighted disks 142 are added to the barbell 140 on the outside of the vertical members 82.

Figure 10A:
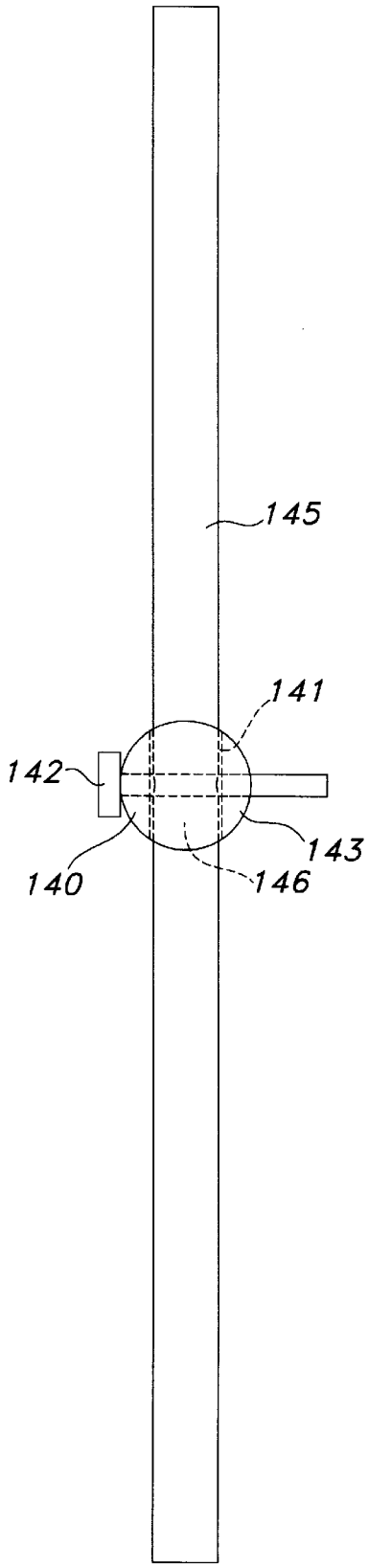
FIG. 10A is a detailed drawing showing a turning handle connected to a barbell.
Figure 10B:
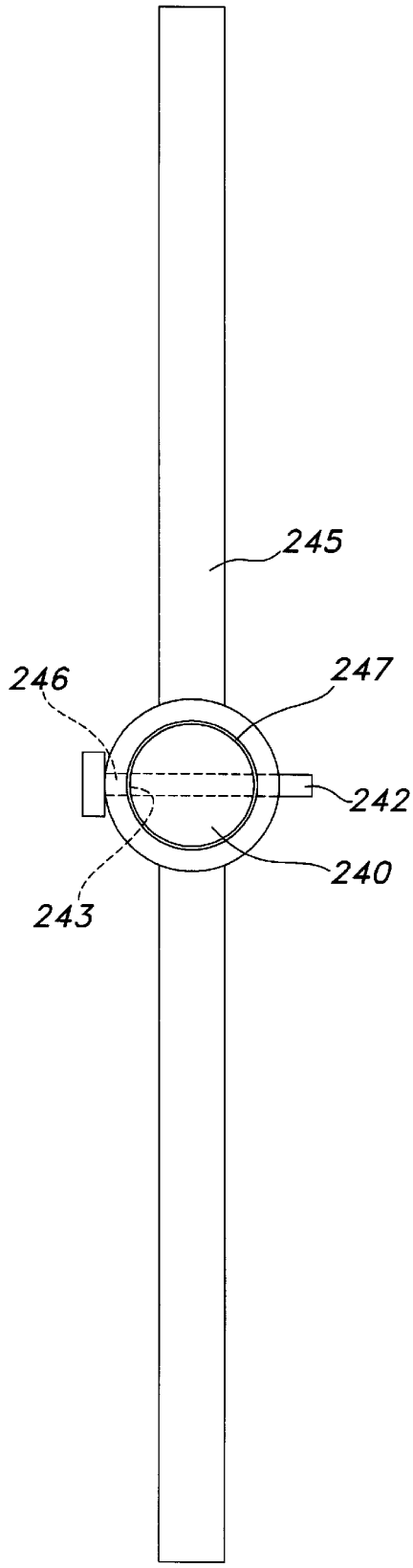
FIG. 10B is an alternative embodiment of a turning handle connected to a barbell.

With reference to FIG. 10A, at each end of the barbell 140 there is a large hole 141 and a smaller hole 143. The large hole 141 is designed to receive a turning bar 145 therethrough. The turning bar 145 has a hole 146 which, when aligned with smaller hole 143, is able to receive a turning bar retaining pin 142 therethrough. Alternatively, as shown in FIG 10B, the turning bar 245 may define an opening 247 sized to circumferentially fit around the end of the barbell 240. A retaining pin 242 is then inserted into a hole 246 in the turning bar 245 and into a cooperating hole 243 in the barbell 240 to lock the turning bar 245 in position on the barbell 240. As will be appreciated by those skilled in the art, other means for attaching a turning bar to a barbell are available and are intended to fall within the scope and content of the present invention.

With the afore-described equipment described with reference to FIGS. 1–10, I turn now to the system and methods of using that equipment to perform the weight training exercises of the present invention.

With reference to FIG. 1, there is shown a silhouetted FIG. 10 in the initial position for what I have called the "belt over lower back" lifting operation. The FIG. 10 is leaning forward, back straight, arms 12 supporting the upper body by use of the upper body support structure 60. In this example, the FIG. 10 is using the second lowest hand grip 63 for support. The hoisting belt 20 is placed over the lower back and upper pelvic portion of the FIG. 10. The hoisting belt 20 is connected to the barbell 40 using connecting star 48. The appropriate loops 53*a*, 54*a*, 55*a*, 56*a*, 57*a* are chosen so that the length of the hoisting belt 20 is such that the hoisting belt 20 fits over the lower back and upper pelvis region when the legs are slightly bent. The sides of the hoisting belt 20 should preferably be substantially vertical in the initial position for this exercise. The barbell 40 should be positioned just in front of the shin, but may be touching the shin. Because of the extreme weights involved, I recommend that shin protection be worn which may, for example, include shin guards similar to those worn in the sport of soccer or any other type of adequate protection. I also recommend wearing loose fitting boots (not shown) made of one-quarter (¼) inch felt over the shin guards for additional protection. Finally, I recommend that the footing be secure by adding abrasive strips and/or imbedded sand to the floor structure to increase friction between the protective boots and the floor.

Once the user 10 is in the correct initial body position with the weight apparatus 18 appropriately positioned, the user 10 preferably inhales, and while holding that breath, pushes down on the floor with his or her feet. That movement will have the effect of straightening the user's legs and raising his or her lower back and pelvic area. This in turn will raise the hoisting belt 20. The hoisting belt 20 will raise the barbell 40 together with the attached weights 42. It should be noted that the entire weighted apparatus 18 preferably only moves off the floor a few inches. That small amount of movement of the weighted apparatus 18 is consistent with the intended advantage that the lifting exercise is performed using a relatively small range of motion. For the purposes of this and the other exercises described herein, a small or limited range of motion is defined as less than about thirty-five percent (35%) of what would be considered full range of motion on exercises not utilizing the present invention.

Additional weight is then added for the next repetition. In the preferred embodiment of the system, each level of weight added to the weighted apparatus 18 should be lifted only once prior to increasing the weight again. I prefer that this process be repeated five to six times to reach the maximum amount of weight for that workout session. After achieving the daily maximum lift, I prefer that the user 10 reduce the amount of weight to about 60% of the maximum and perform three (3) repetitions at that weight. Finally, I prefer that individuals perform this and the other exercises about once per week for the first five or six weeks, then gradually extend the time between workouts to ten days.

In performing these weight lifting exercises in trials, individuals have been able to lift well over two thousand (2000) pounds. Many users will be able to lift in excess of five hundred (500) pounds on their initial workout. Moreover, the progression from the initial daily maximum upward appears to be relatively quick and often significant improvements are seen from one workout to the next.

Figure 11:
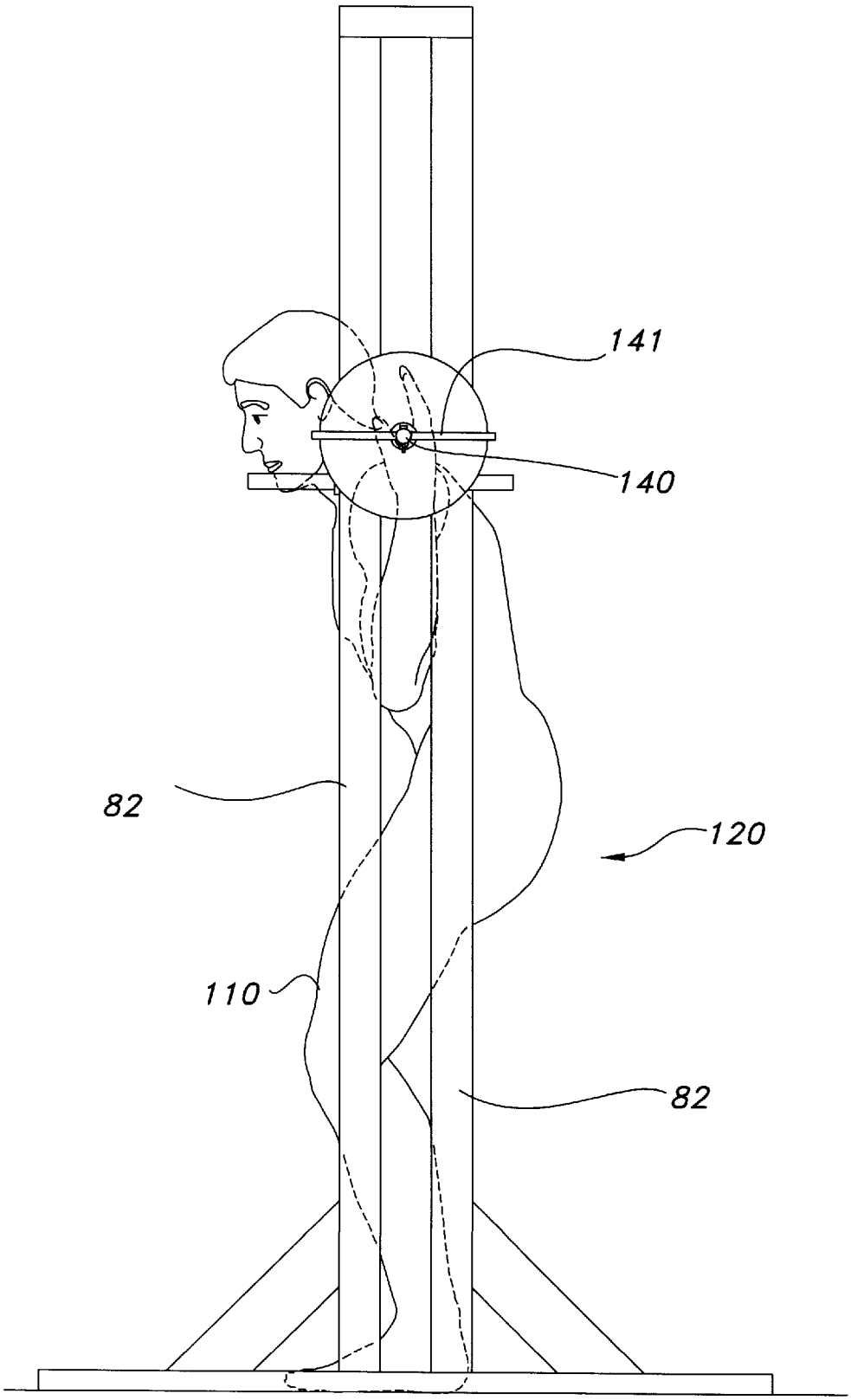
FIG. 11 is a side view of the modified squat lifting operation of the present invention.

With reference to FIG. 11, there is shown a FIG. 110 in the initial position 120 for an exercise which I call "Modified Squats". In this exercise, the retaining pins 86 are inserted through holes 84 so that the barbell 140 rests just lower than shoulder height. The user 10 stands in the opening 90 of the barbell support structure 80 and bends slightly at the knees, back straight, and grips the barbell 140 above his shoulders and behind his or her neck. Weights 141 are placed on the barbell 140. The user 10 then takes a deep breath and holds that breath as he or she pushes down on the floor with the feet. Preferably, there is no lifting accomplished with the arms. Pushing the feet down has the effect of lifting the barbell 140 a few inches off of the retaining pins 86. The barbell 140 is then lowered back onto the retaining pins by bending the legs at the knees. Using this technique, the weight is lifted only through a limited range of leg motion, and a much heavier weight may be lifted than in a normal squat-type exercise. Because of the heavy weights involved, I recommend using a standard weight belt around the abdomen area for additional support while lifting. Like the previous exercise, I recommend performing one repetition at each weight, building to a daily maximum in about 5 or 6 repetitions. Thereafter, the weight should be reduced to about sixty percent (60%) of the daily maximum and three repetitions be performed at that weight.

Figure 12:
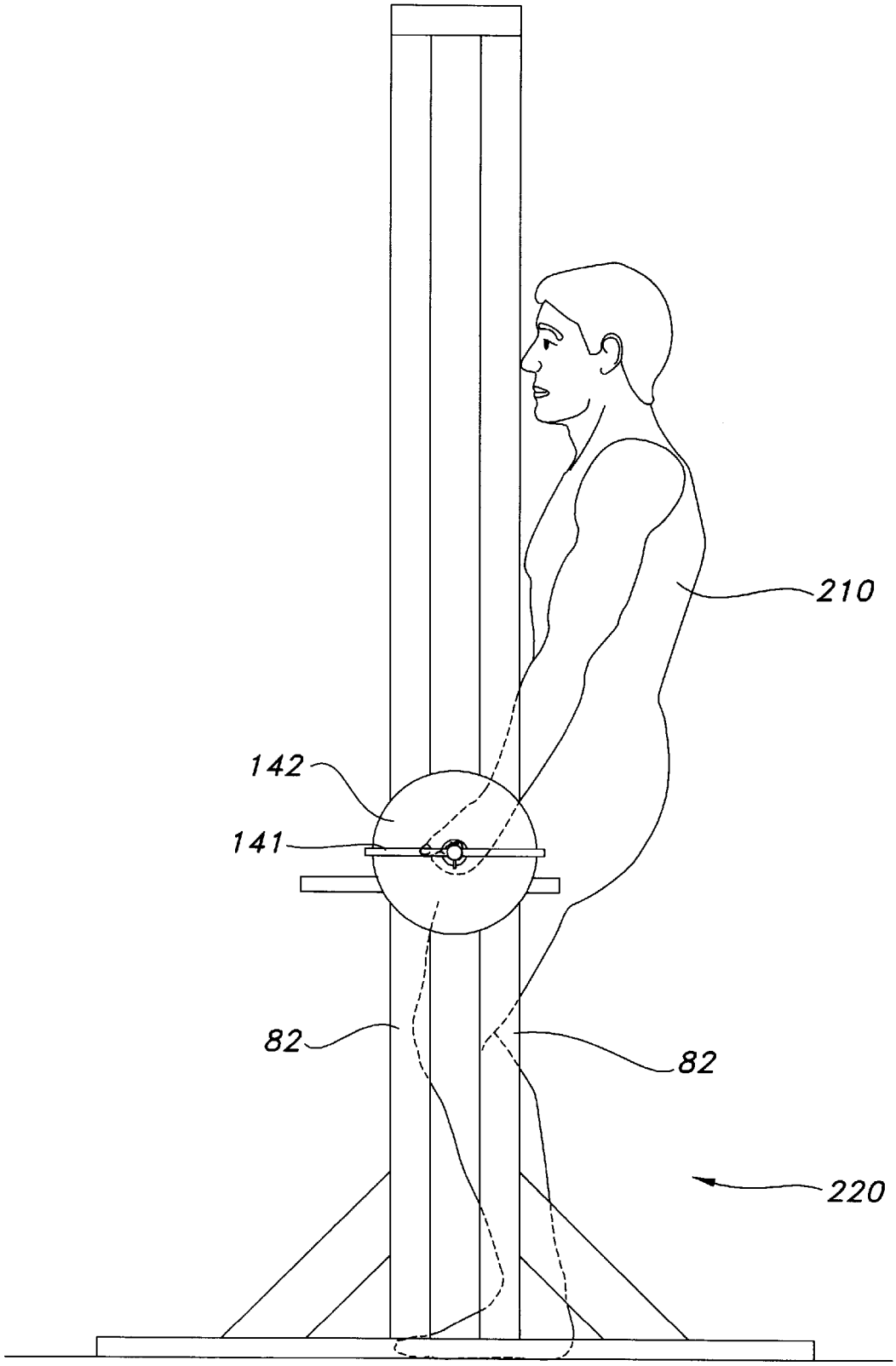
FIG. 12 is a side view of the bend and pull lifting operation of the present invention.

Turning now to FIG. 12, there is shown a FIG. 210 in the initial position 220 for an exercise I call the "Bend and Pull" lifting exercise, In this exercise, the retaining pins 86 are inserted through holes 84 so that the barbell 140 rests just lower than waist height and just lower than the arms when resting at the side of the fully upright body. The user 210 stands in the opening 90 of the barbell support structure 80. The user 210 bends slightly at the knees, back straight, and grips the barbell 140 in front of his or her thighs. Appropriate amount of weights 141 are placed on the barbell 140. The user 10 then takes a deep breath and holds that breath as he or she pushes down on the floor with the feet. Preferably, there is no lifting accomplished with the arms. Pushing the feet down has the effect of lifting the barbell 140 a few inches off of the retaining pins 86. The barbell 140 is then lowered back onto the retaining pins by bending the legs at the knees. Using this technique, the weight is lifted only through a limited range of motion, and a much heavier weight may be lifted than in a normal "dead-lift"-type exercise. Because of the heavy weights involved, I recommend using a standard weight belt around the abdomen area for additional support while lifting. I also recommend using wrist straps wrapped around the barbell 140 to strengthen the grip thereon. Like the previous exercise, I recommend performing one repetition at each weight, building to a daily maximum in about 5 or 6 repetitions. Thereafter, the weight should be reduced to about sixty percent (60%) of the daily maximum and three repetitions be performed at that weight.

Figure 13:
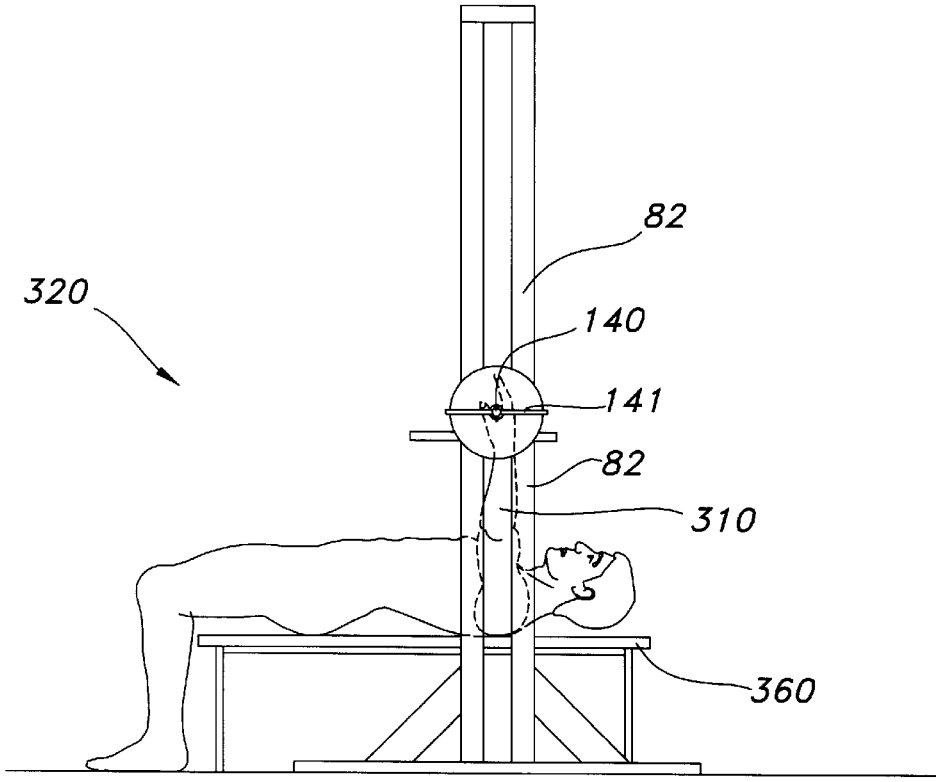
FIG. 13 is a side view of the expanded chest press lifting operation of the present invention.

Turning now to FIG. 13, there is shown a FIG. 310 in the initial position 320 for an exercise I call the "Chest Expansion" exercise. The user 310 lies on his or her back in the opening 90 of the barbell support structure 80. The user may lie on the floor, a gymnastic mat, or on a more traditional bench 360, but because the exercise will not involve the full range of motion as a standard bench press exercise, a bench is not necessary. In this exercise, the retaining pins 86 are inserted through holes 84 so that the barbell 140 rests just lower than the full extension of the arms when extended above the body. The user 310 bends the arms slightly at the elbows and grips the barbell 140 just slightly wider than the shoulders. Appropriate amount of weights 141 are placed on the barbell 140. The user 310 then takes a deep breath and holds that breath as he or she extends the arms until the elbows are locked. This has the effect of lifting the barbell 140 a few inches off of the retaining pins 86. The barbell 140 is then lowered back onto the retaining pins by bending the arms at the elbows. Using this technique, the weight is lifted only through a limited range of arm motion, and a much heavier weight may be lifted than in a normal "bench-press" type exercise. Because of the heavy weights involved, I recommend using a standard weight belt around the abdomen area for additional support while lifting. I also recommend using protection for the wrists and palms of the hands, preferably in the form of wrist supports and padded gloves. Like the previous exercises, I recommend performing one repetition at each weight, building to a daily maximum in about 5 or 6 repetitions. Thereafter, the weight should be reduced to about sixty percent (60%) of the daily maximum and three repetitions be performed at that weight.

Figure 14:
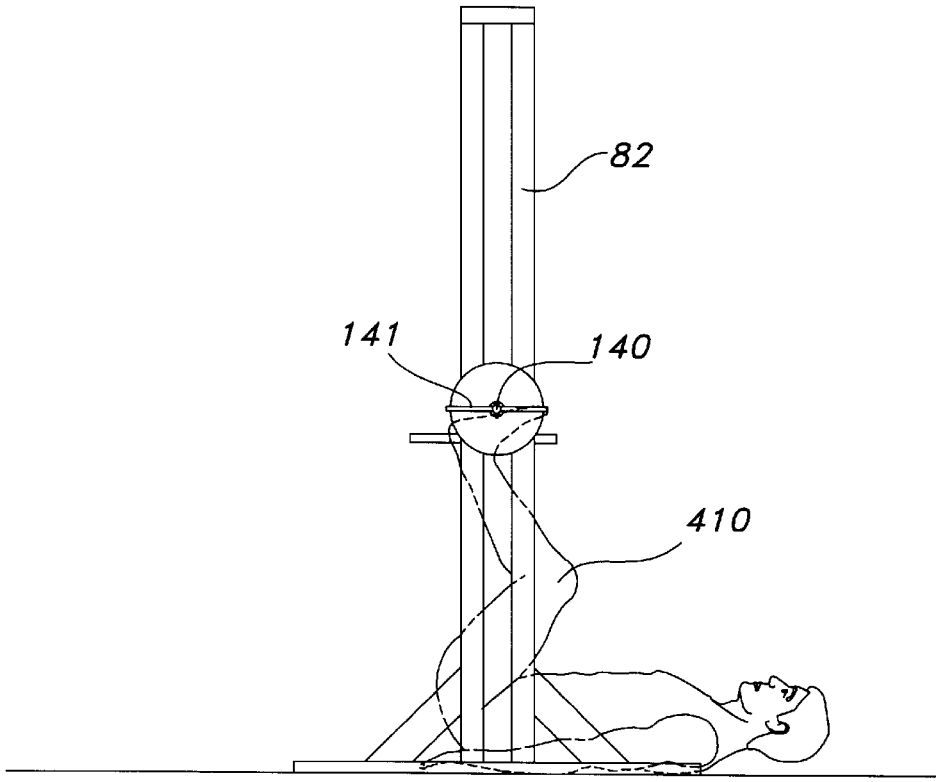
FIG. 14 is a side view of the lock by legs lifting operation of the present invention.

Turning now to FIG. 14, there is shown a FIG. 410 in the initial position 420 for an exercise I call the "Lift by Leg Lock" exercise. The user 410 lies on his or her back in the opening 90 of the barbell support structure 80. The user may lie on the floor or on a mat. In this exercise, the retaining pins 86 are inserted through holes 84 so that the barbell 140 rests just lower than the full extension of the legs when the legs are extended above the body. The user 410 bends the legs slightly at the knees and places the soles of the feet under the barbell 140. Appropriate amount of weights 141 are placed on the barbell 140. The user 410 then takes a deep breath and holds that breath as he or she extends the legs until the knees are locked. This has the effect of lifting the barbell 140 a few inches off of the retaining pins 86. The barbell 140 is then lowered back onto the retaining pins by bending the legs at the knees. Using this technique, the weight is lifted only through a limited range of leg motion, and a much heavier weight may be lifted than in a normal "leg-press" type exercise. Because of the heavy weights involved, I recommend using a standard weight belt around the abdomen area for additional support while lifting. I also recommend using protection for the soles of the feet such as tennis or running shoes. Like the previous exercise, I recommend performing one repetition at each weight, building to a daily maximum in about 5 or 6 repetitions. Thereafter, the weight should be reduced to about sixty percent (60%) of the daily maximum and six repetitions be performed at that weight, each repetition being performed with the barbell contact point located at a different point along the soles of the feet.

Finally, the lock by leg lift exercise is preferably continued by a turning foot massage exercise. The weights 141 on the barbell 140 are further reduced to less than fifty (50%) of the daily maximum weight. The turning handle 145 is inserted into the barbell 140 as shown in FIG. 10A or FIG. 10B. Then, the user 410 lifts the barbell 140 until the knees are fully extended. A second person (not shown) then turns the turning handle 145, thereby rolling the barbell 140 along the soles of the feet. As will be appreciated by those skilled in the art, the rolling motion has the effect of moving the soles of the feet along underside of the barbell 140. I recommend that the turning be performed by first turning the handle clockwise until the end of the sole is reached, then reversing direction until the other end of the sole is reached, and continuing until three (3) or four (4) full cycles have been completed.

The principles, preferred embodiments and the modes of operation of the present invention have been described in the foregoing specification. However, the invention which is intended to be protected is not to be construed as limited to the particular embodiments disclosed. The embodiments are therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What I claim is:

1. A weight lifting system comprising:

a plurality of weighted disks, each of said disks having an aperture in the center thereof;

a barbell having two ends, each of said ends formed to receive the aperture of at least one of said weighted disks thereon and wherein the combination of weighted disks and the barbell are initially resting on a surface;

a flexible, non-elastic hoisting belt having two ends and a middle portion between the two ends wherein each of said ends is connected to the barbell and wherein said middle portion of said hoisting belt is configured to be positioned over a portion of a user's lower back and wherein said barbell is lifted from the surface by lifting the hoisting belt with said user's lower back; and a support structure positioned in front of the barbell whereby the user's upper body is supported in a forward leaning position while the hoisting belt is being lifted.

2. A weight lifting system comprising:

a plurality of weighted disks, each of said disks having an aperture in the center thereof;

a barbell having two ends, each of said ends formed to receive the aperture of at least of one of said weighted disks thereon;

a hoisting belt connected to the barbell wherein said barbell is lifted by lifting the hoisting belt;

a connecting star having an aperture therethrough, said aperture sized to fit around said barbell and wherein said hoisting belt is connected to said barbell using said connecting star.

3. The weight lifting system of claim 2 wherein the connecting star comprises a loop and wherein said belt has a connecting bar sized to fit within said loop.

4. The weight lifting system of claim 2 wherein the connecting star comprises a plurality of loops and wherein said belt has a connecting bar sized to fit within said plurality of loops.

5. The weight lifting system of claim 4 wherein the said plurality of loops are varied in size.

6. A belt for lifting a weighted bar wherein the weighted bar is initially resting on a surface, comprising:

a flat portion having two ends;

a middle portion between the two ends; and a connecting structure attached to each of said ends and wherein said connecting structures are configured to connect to opposing sides of the weighted bar thereby enabling the belt to lift the weighted bar from the surface and wherein said middle portion of said belt is configured to be positioned over a portions of a user's lower back while the user's upper body is supported in a leaning forward position by a support structure.

7. The belt of claim 6 wherein said connecting structure is a connecting bar.

8. The belt of claim 7 wherein said connecting bar forms an "H" configuration.

9. The belt of claim 6 wherein said connecting structure is a buckle.

10. The belt of claim 6 wherein said connecting structure is a tie.

11. The belt of claim 6 wherein said connecting structure is a snap-on connector.

12. The belt of claim 6 wherein said connecting structure is a clip.

13. A method for lifting a barbell, initially resting on a surface, using a flexible, non-elastic belt having two ends and a middle portion between the ends, comprising:

connecting each end of said belt to said barbell;

supporting a user's upper body in a forward leaning position using a support structure;

positioning said middle portion of said belt over a portion of the user's lower back; and lifting the barbell from the surface by lifting said belt with said user's lower back.

14. The method of claim 13 further comprising the step of placing said belt over a lower back of an individual.

15. The method of claim 14 wherein said lifting step is performed using a limited range of motion.

16. The method of claim 13 wherein said belt includes a connecting bar and wherein said connecting step includes placing a connecting star on each end of said barbell and connecting said connecting bar to said connecting star.

17. The method of claim 16 further comprising the step of placing said belt over the lower back.

18. The method of claim 17 wherein said lifting step is performed using a limited range of motion.

19. The method of claim 16 wherein said connecting star has a plurality of loops defined therein.

20. The method of claim 19 wherein said plurality of loops are of various sizes.

21. A weight lifting system comprising:

a weighted bar initially resting on a surface; and a flexible, non-elastic hoisting belt having two ends and a middle portion between the two ends wherein each of said ends is connected to the weighted bar and wherein the middle portion of said hoisting belt is configured to be positioned over a portion of a user's lower back and wherein said barbell is lifted from the surface by lifting the hoisting belt with said user's lower back, and a support structure positioned in front of the barbell whereby the user's upper body is supported in a forward leaning position while the hoisting belt is being lifted.

22. The weight lifting system of claim 21 wherein the weight of said weighted bar is variable.

23. The weight lifting system of claim 21 wherein the hoisting belt is sized to fit over a lower back of an individual when the bar is at rest.

24. A method for lifting a weighted bar initially resting on a surface using a belt having two ends and a center portion between the two ends, comprising the steps of:

connecting each of the ends of said belt to said weighted bar;

Positioning the center portion of said belt over a portion of a user's lower back;

supporting a user's upper body in a forward leaning position using a support structure; and lifting the weighted bar from the surface by lifting said belt with the user's lower back.

25. The method of claim 24 wherein said belt is sized to fit over a lower back of an individual when said bar is at rest and wherein said belt is placed over the lower back.

26. The method of claim 24 wherein the weight of said weighted bar is variable.

27. A weight lifting system comprising:

a plurality of weighted disks, each of said disks having an aperture in the center thereof;

a barbell having two ends, each of said ends formed to receive the aperture of at least one of said weighted disks thereon and wherein the combination of weighted disks and the barbell are initially resting on a surface;

a flexible, non-elastic hoisting belt having two ends and a middle portion, wherein each of said ends is connected to the barbell and wherein said middle portion of the hoisting belt is configured to be positioned over a portion of a users' lower back and wherein said barbell is lifted from the surface by lifting the hoisting belt;

a support structure positioned in front of the barbell whereby the user's upper body is supported in a forward leaning position while the hoisting belt is being lifted, and means for connecting said hoisting belt to said barbell.

* * * * *